US009638031B2

(12) United States Patent
Li et al.

(10) Patent No.: US 9,638,031 B2
(45) Date of Patent: May 2, 2017

(54) METHOD OF CONTROLLING WELL BORE PRESSURE BASED ON MODEL PREDICTION CONTROL THEORY AND SYSTEMS THEORY

(75) Inventors: Zhilin Li, Guanghan (CN); Bin Dong, Guanghan (CN); Haifang Sun, Guanghan (CN); Liexiang Han, Guanghan (CN); Runde Xiao, Guanghan (CN); Bo Yang, Guanghan (CN); Gui Tang, Guanghan (CN); Qiulai Xue, Guanghan (CN); Qiang Wei, Guanghan (CN); Guojun Tang, Guanghan (CN); Xing Zuo, Guanghan (CN)

(73) Assignee: CHINA NATIONAL PETROLEUM CORPORATION CHUANQING DRILLING ENGINEERING CO., LTD., Chengdu, Sichuan (CN)

( * ) Notice: Subject to any disclaimer, the term of this patent is extended or adjusted under 35 U.S.C. 154(b) by 398 days.

(21) Appl. No.: 14/351,573

(22) PCT Filed: Nov. 4, 2011

(86) PCT No.: PCT/CN2011/001867

§ 371 (c)(1),
(2), (4) Date: Apr. 13, 2014

(87) PCT Pub. No.: WO2013/059971

PCT Pub. Date: May 2, 2013

(65) Prior Publication Data

US 2014/0262246 A1 Sep. 18, 2014

(30) Foreign Application Priority Data

Oct. 28, 2011 (CN) ..... 2011 1 0332763

(51) Int. Cl.
*G05D 16/00* (2006.01)
*E21B 49/00* (2006.01)
(Continued)

(52) U.S. Cl.
CPC ..... *E21B 49/00* (2013.01); *E21B 21/08* (2013.01); *E21B 41/0092* (2013.01); *E21B 47/1025* (2013.01)

(58) Field of Classification Search
CPC ..... F04B 47/02; F04B 47/026; C04B 22/00; E21B 41/0064; E21B 21/08; E21B 43/26; E21B 44/00; E21B 49/00; G01V 11/00
See application file for complete search history.

(56) References Cited

U.S. PATENT DOCUMENTS 4,340,427 A * 7/1982 Sutton ..... C04B 22/00 106/640
8,844,626 B1 * 9/2014 Krug ..... F04B 47/026 166/250.08
(Continued)

*Primary Examiner* — Tuan Vu

(57) ABSTRACT

A method for controlling well bore pressure based on model prediction control theory and systems theory, includes: detecting a well bottom pressure, a stand pipe pressure, a casing pressure, an injection flow rate and an outlet flow rate during the drilling operation process and determining the presence of overflow or leakage; if there is no overflow or leakage, then fine-adjusting the wellhead casing pressure according to the slight fluctuations of the well bottom pressure, the stand pipe pressure or the casing pressure; if there is overflow or leakage, simulating and calculating the overflow or leakage position and starting time of the overflow or leakage, predicting the variation over a future time period of the well bore pressure in the well drilling process, and utilizing an optimization algorithm to calculate the control parameter under a minimum of an actual well bottom pressure difference during the future period.

6 Claims, 3 Drawing Sheets

(51) Int. Cl.

| | |
|---|---|
| ***E21B 47/10*** | (2012.01) |
| ***E21B 41/00*** | (2006.01) |
| ***E21B 21/08*** | (2006.01) |

(56) References Cited

U.S. PATENT DOCUMENTS

| | | | | |
|---|---|---|---|---|
| 8,851,860 | B1 * | 10/2014 | Mail | F04B 47/02 166/105 |
| 2005/0119911 | A1 * | 6/2005 | Ayan | G01V 11/00 703/10 |
| 2008/0319726 | A1 * | 12/2008 | Berge | E21B 41/0064 703/10 |
| 2010/0224365 | A1 * | 9/2010 | Abad | E21B 43/26 166/275 |
| 2010/0288507 | A1 * | 11/2010 | Duhe | E21B 21/08 166/370 |

* cited by examiner

METHOD OF CONTROLLING WELL BORE PRESSURE BASED ON MODEL PREDICTION CONTROL THEORY AND SYSTEMS THEORY

CROSS REFERENCE OF RELATED APPLICATION

This is a U.S. National Stage under 35 U.S.C 371 of the International Application PCT/CN2011/001867, filed Nov. 4, 2011, which claims priority under 35 U.S.C. 119(a-d) to CN 201110332763.2, filed Oct. 28, 2011.

BACKGROUND OF THE PRESENT INVENTION

Field of Invention

The present invention relates to a field of control technique for well bore pressure, and more particularly to a method for controlling well bore pressure based on model prediction control theory and systems theory, which is capable of ensuring that the pressure traverse of the well bottom or the well bore controlled thereby is in a safety window, and that wellhead pressure controlled thereby is safe for the well bore.

Description of Related Arts

In recent years, with the increasingly development of petroleum and natural gas exploration and exploitation, well drilling is increasingly processed in various complicated structure areas. The conventional OBD pressure control technique is not capable of meeting production requirements such as well drilling in complicated structure areas, narrow density window security drilling, drilling in $H_2S$ bearing layer, diameter-shrinkage bit block caused by high density mud leakage and well-control risk caused by high density mud leakage. Since the OBD pressure control technique is still a type of conventional manual rough pressure control, which achieves the object of controlling the well bottom pressure depending on experiences of the onsite operators, wherein a relative steady state often can not be achieved in the well by regulating the throttle valve repeatedly, and furthermore, the well bottom pressure has a wide fluctuation which can not be controlled in a small range to have an approximately constant well bottom pressure. However, adopting fine pressure control technique is capable of processing well drilling in complicated structure areas, such as narrow density window drilling, and decreasing 80% of the problems encountered in the conventional well drilling technique.

Because the well is a fuzzy system with large quantity of uncertainties therein, the conventional wellhead constant pressure control measure results in a failure of well bore pressure fine control or even causes accidents. Particularly in the condition of overflow, the wellhead, the casing pressure increases opening degree of the throttle valve, which is reflected in the wellhead, but actually the overflow causes that the bottom fluid further enters the well bore, which decreases the well bottom pressure. In addition, during the process of drilling, fluctuation of the well bottom pressure and the well bore pressure is required to be smaller and smaller, and a failure of pressure control is easily caused even by a slight mistake, so that complicated accidents such as well overflow are caused.

A large quantity of the conventional pressure control methods are focused on well bore flow. However, after searching, a set of pressure calculating prediction control method which is capable of ensuring a safe pressure control for the well bore at any time has not been disclosed yet. If the problem can not be satisfactorily solved, the popularization and application effects of underbalanced drilling technique (UBD) and managed pressure drilling technique (MPD) are directly influenced; risk of well drilling control is increased; and cost of well drilling is high, so that a large quantity of oil fields which are supposed to be developed earlier can not be developed in time.

Yang Xiongwen, Zhou Yingcao, Fang Shiliang and Liu Wei disclose a periodical literature with a title: *Design and laboratory test of hierarchical intelligent control system for managed pressure drilling* on a Journal Petroleum Drilling Techniques, Vol. 39 No. 4, July 2011, wherein an MPD multi-level hierarchical control strategy is disclosed, but technical problems are still not solved as follows.

1. The control objective of is to control wellhead pressure. Though an objective mentioned in the literature is to control the well bottom pressure, in the block diagrams 2, 3 and 4 and descriptions thereof, the objective is based on controlling the wellhead pressure. The wellhead pressure control is only a small part of the practical well bore pressure control, which is equivalent to manipulating the conventional manually operated throttle by people, so as to ensure that the wellhead pressure is equal to a set value. However, it is still an unresolved issue of how to control the well bottom pressure by controlling the wellhead pressure, i.e., how to control the well bottom pressure to a set value.

2. In the calculation, it is difficult to obtain exactly the overflow discharge. The overflow discharge monitored at the wellhead is variations of the overflow while reaching the wellhead. Depending on the overflow discharge monitored thereof for calculating and controlling is already too late, and thus an object of precision control can not be reached.

SUMMARY OF THE PRESENT INVENTION

In order to solve the technical problem existed in the prior art of not capable of ensuring that pressure control is safe for the well bore at any time, the present invention provides a method for controlling well bore pressure based on model prediction control theory and systems theory, which is capable of controlling the well bore pressure to be at an engineering permissible fluctuation range, so as to achieve an object of controlling the pressure precisely.

The present invention is implemented by technical solutions as follows.

A method for controlling well bore pressure based on model prediction control theory and systems theory, comprises steps of:

detecting a well bottom pressure, a stand pipe pressure, a casing pressure, an injection flow rate and an outlet flow rate during construction process;

determining presence of overflow or leakage;

if there is no overflow or leakage, then fine-adjusting the wellhead casing pressure according to difference values between the well bottom pressure, the stand pipe pressure, the casing pressure and target pressures thereof, or the slight fluctuations of the well bottom pressure, the stand pipe pressure or the casing pressure, so as to ensure that the well bottom pressure, the stand pipe pressure or the vertical casing pressure is at set value, wherein adjusting amount is optimized according to a conventional model prediction control algorithm, so as to calculate a control objective parameter of a next moment to ensure that the well bottom pressure, the stand pipe pressure or the casing pressure is at the set value;

if there is overflow or leakage, then using a well bore single-phase or multi-phase flow dynamic model to simulate and calculate the overflow or leakage position and starting time of the overflow or leakage, predicting the variation over a future time period of the well bore pressure in the well drilling process, and utilizing an optimization algorithm to calculate the control parameter under a minimum of an actual well bottom pressure difference during a future period; and repeating the optimization process for the next time period after a first control parameter is selected and set.

A prediction control equation of the single-phase or multi-phase flow dynamic model is expressed by the following formula:

$$\begin{cases} \dot{\vec{x}} = f_R[\vec{x}(t), u(t), \Delta Q_{KL}] \\ y(t) = g_R[\vec{x}(t)] + e_y \end{cases}, \tag{1}$$

wherein $f_R[\bullet]$, $g_R[\bullet]$ respectively represent well bore pressure system, a computing model thereof is calculated by theoretical formula of hydraulic single-phase flow and multi-phase flow;

$\vec{x}(t)$ represents a state vector at a moment of t, including the casing pressure;

u(t) represents the casing pressure at the moment of t;

y(t) represents the well bottom pressure at the moment of t; and $e_y$ represents an error of the well bottom pressure.

Furthermore, technical solution of the present invention further comprises processing discretization on the multi-phase flow dynamic model obtained above, comprising:

converting the well bore continuous model established into the following discrete model:

$$\begin{cases} \tilde{\vec{x}} = f_M[\tilde{\vec{x}}(k-1), \tilde{u}(k), \tilde{u}(k-1), \Delta\tilde{\vec{Q}}_{KL}] \\ \tilde{y}(k) = g_M[\tilde{\vec{x}}(k)] \end{cases}, \tag{2}$$

wherein $\tilde{\vec{x}}$ represents a state vector at a moment of k;

$\tilde{u}(k)$ represents the casing pressure at the moment of k;

$\Delta\vec{Q}_{KL}$ represents ground leakage or overflow vector; and $\tilde{y}(k)$ represents a calculated value of the well bottom pressure at the moment of k;

wherein casing pressures within time intervals of two moments are obtained by processing linear interpolation on two casing pressures u(k−1) and u(k) which are respectively at two adjacent time intervals of k−1 moment and k moment.

An error between an actual measurement casing pressure and a prediction calculation casing pressure is a prediction error e(k+i), $$\text{wherein } e(k+i)=y_p(k)-y_M(k) \tag{3}$$

wherein $y_M(k)$ is an output value of a moment k; $y_p(k)$ is an actual measurement value of the moment k.

A predicted value e(k+i) at a moment n+i in the future is estimated by a polynomial error fitting method based on values at a given moment, wherein the predicted value e(k+i) comprises an error at a moment k and a revised error, wherein during this process (L>l2>1), and when L=l2

$$\begin{aligned} e(k+i) &= e(k) + \sum_{i=1}^{l_2} e_l(n)i^l \\ &= y_p(k) - y_M(k) + \sum_{i=1}^{l_2} \beta_l(n)i^l \\ (i &= 1, 2, 3, \ldots, L) \end{aligned} \tag{4}$$

wherein e(k) is an error at the moment k;

$\beta_1(k)$ is a coefficient of a fitting polynomial;

$l_2$ is expanded orders of the fitting polynomial.

The well bottom pressure is obtained according to exponential curve close to a reference pressure $y_{ref}$, at the moment, a reference curve of the well bottom pressure is expressed as the following formula:

$$r(k+i\,|\,k) = y_{ref} - e^{-\frac{iT_s}{T_{ref}}}\varepsilon(k) \tag{5}$$

wherein i=(1, 2, . . . $H_P$);

wherein $T_s$ represent a sampling time;

$T_{ref}$ represents an exponential time of the reference curve;

wherein symbol r(k+i|k) means evaluating reference curve at a moment (k+i) according to thereof the moment of k and predicting the well bottom pressure according to a nonlinear model, wherein when the well bottom pressure exceeds prediction range of the model, a previous input curve $\hat{u}(k+i|k)$ is utilized to predict the well bottom pressure, wherein:

$$\hat{\vec{x}}(k+i|k)=f_P[\hat{\vec{x}}(k+i-1),\hat{u}(k+i|k),\hat{u}(k+i-1|k),\hat{u}(k+i-2), \ldots ,\hat{u}(k|k)] \tag{6}$$

$$\hat{y}(k+i|k)=g_P[\hat{\vec{x}}(k+i|k)] \tag{7}$$

wherein $f_P$ is calculated according to theoretical formula of well bore hydraulic single-phase flow and multi-phase flow.

Calculating the control parameter under the minimum actual well bottom pressure difference over the future period utilizing an optimization algorithm specifically comprises a step of:

optimizing prediction output values of the process in a plurality of fitting points to be closest to a reference trajectory, wherein optimization performance indexes thereof are quadratic performance indexes and are obtained by optimization method, wherein:

$$\min J_p = \sum_{i=1}^{m} (y_r(k+i) - \tilde{y}_M(k+i))^2 \tag{8}$$

$$\tilde{y}_M(k+i) = y_M(k+i) + e(k+i) \tag{9}$$

wherein (k+i) is a (k+i)th fitting time, m is a number of the fitting points, $\tilde{y}_M(k+i)$ is a prediction value of the process, $y_M(k+i)$ is a model prediction output at a moment of (k+i), e(k+i) is a prediction error, $y_r(k+i)$ is a reference trajectory at the moment of (k+i), wherein an optimal parameter of real-time control is obtained by calculating a minimum value of the formulas mentioned above.

When a casing pressure order is given to a casing pressure control device, monitoring system of the casing pressure control device executes control order, wherein during the executing process, opening degree of the throttle valve is executed according to a conventional automatic control model prediction MPC feedback control algorithm, which is as described in the reference 1, and is omitted here.

The minimum actual well bottom pressure difference mentioned above means a minimum pressure for generating a minimum overflow leakage.

The control parameter under the minimum actual well bottom pressure difference mentioned above comprises the vertical casing pressure, the injection flow rate, density and viscosity of drilling fluid.

The method of the present invention comprises, but is not limited to a method for controlling model prediction system based on PWD measured data.

The method of the present invention comprises, but is not limited to hydraulic model checking method based on measured data.

Compared with the prior arts, technical effects of the present invention are as follows.

1. According to the method of the present invention, monitoring and predicting in real time and online pressure history of the wellhead and the well bottom for some time in the future, optimizing control volume thereof, adjusting and controlling target casing pressure, which is reflected in the execution unit as adjusting opening degree of the wellhead throttle valve to control the casing pressure, in such a manner that the pressure of the well bottom maintains in a safe window, so as to solve the technical problem existed in the prior arts of not capable of ensuring a safe pressure control for the well bore at any time, in such a manner that the well bore pressure is controlled in an engineering permissible fluctuation range and the object of precise pressure control is achieved. Furthermore, utilizing the method of the present invention is beneficial for significantly reducing underground complex accidents during the process of oil and gas drilling, and improving exploration and exploitation benefit, and thus has great significance.

2. The method of the present invention adopts predictive error and thus is capable of further improving fineness of the control method.

3. The method of the present invention processes estimation based on values at given moment, so as to improve precision of the error prediction.

4. In the present invention, based on a principle that the well bore is a fuzzy large-scale system, the well bottom pressure or the wellhead vertical casing pressure serves as the control target. Calculation of the well bottom pressure is based on basic theory of well bore fluid mechanics, processes model prediction and model processing according to calculated results and actual results, so as to provide an ultimate target value of control casing pressure, in such a manner that the well bottom pressure maintains at a target value all the time and the well bore pressure stays in a safety range, so as to overcome the disadvantages in the prior arts of considering only adjusting opening degree of the throttle valve and depending only on the model prediction control (MPC) algorithm.

5. Compared with the Design and laboratory test of hierarchical intelligent control system for managed pressure drilling in the periodical literature of the prior art, the method of the present invention adopts the technical solution that "if there is no overflow or leakage, then fine-adjusting the wellhead casing pressure according to a difference value between the well bottom pressure or the vertical casing pressure and a target pressure, or the slight fluctuations of the well bottom pressure or the vertical casing pressure, so as to ensure that the well bottom pressure or the vertical casing pressure are at the set value, wherein adjusting amount is optimized according to a conventional model prediction control algorithm, so as to calculate a control objective parameter of a next moment", and is capable ensuring the well bottom pressure or the casing pressure maintains at the target set value.

6. Compared with the Design and laboratory test of hierarchical intelligent control system for managed pressure drilling in the periodical literature of the prior art, the method of the present invention adopts the technical solution that "if there is overflow or leakage, then using a well bore single-phase or multi-phase flow dynamic model to simulate and calculate the overflow or leakage position and the overflow or leakage starting time, predicting the variation over a future time period of the well bore pressure in the well drilling process, and utilizing an optimization algorithm to calculate the control parameter under the minimum actual well bottom pressure difference over the future period" and achieves an object of precise pressure control.

These and other objectives, features, and advantages of the present invention will become apparent from the following detailed description, the accompanying drawings, and the appended claims.

BRIEF DESCRIPTION OF THE DRAWINGS

Further descriptions of the present invention are illustrated combined with the accompanying drawings and the preferred embodiments, wherein.

SYMBOLS IN THE FIGS

Figure 1:
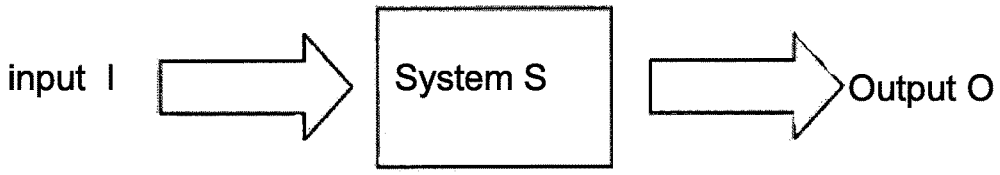
FIG. 1 is an analysis diagram of a prediction system of a well bore pressure model of the present invention.

"I" represents an input, which is a controllable parameter such as master factors comprising density, flow rate and reheological parameter of drilling fluid and other parameters of the well bore, or a real-time variable factor comprising casing pressure;

"S" represents system of the well bore; and

"O" represents an output, i.e., pressure traverse of the well bore or well bottom pressure.

DETAILED DESCRIPTION OF THE PREFERRED EMBODIMENT

Embodiment 1

The present invention discloses a method for controlling well bore pressure based on model prediction control theory and systems theory, comprising steps of:

detecting a well bottom pressure, a stand pipe pressure, a casing pressure, an injection flow rate and an outlet flow rate during construction process;

determining presence of overflow or leakage;

if there is no overflow or leakage, then fine-adjusting the wellhead casing pressure according to the slight fluctuations of the well bottom pressure, the stand pipe pressure or the casing pressure, so as to ensure that the well bottom pressure the stand pipe pressure or the casing pressure is at the set value;

if there is overflow or leakage, then using a well bore single-phase or multi-phase flow dynamic model to simulate and calculate the overflow or leakage position and starting time of the overflow or leakage, predicting the variation over a future time period of the well bore pressure in the well drilling process, and utilizing an optimization algorithm to calculate the control parameter under a minimum of an actual well bottom pressure difference during a future period; and repeating the optimization process for the next time period after a first control parameter is selected and set.

In the technical solution mentioned above, besides the implementing mode thereof, the single-phase or multi-phase flow dynamic model can be implemented utilizing the conventional technique in the field. Besides the implementing mode in the technical solution of the present invention, the optimal algorithm can be implemented utilizing the conventional technique in the filed.

Compared with the prior art, the technical solution of the present invention achieves following technical effects as follows. The method of the present invention is capable of monitoring and predicting in real time and online pressure history of the wellhead and the well bottom for some time in the future according to the actual situation, adjusting opening degree of the wellhead throttle valve to control the casing pressure, in such a manner that the pressure of the well bottom maintains in a safe window, so as to solve the technical problem existed in the prior arts of not capable of ensuring a safe pressure control for the well bore at any time, in such a manner that the well bore pressure is controlled in an engineering permissible fluctuation range and the object of precise pressure control is achieved. Furthermore, utilizing the method of the present invention is beneficial for significantly reducing underground complex accidents during the process of oil and gas drilling, and improving exploration and exploitation benefit, and thus has great significance.

Embodiment 2

According to another preferred embodiment of the present invention, working principle of the present invention and the technical solution utilized thereof are as follows.

1. During the process of controlling the well bore pressure, the well bore is treated as a large scale system for pressure controlling.

During the process of well drilling, due to the uncertainty of formation pressure, the formation fluid may enter the well bore while opening the ground with supply ability, and entrance amount thereof is not only related to formation parameters but also affected by the well bottom pressure. The well bottom pressure is directly influenced by the casing pressure, and is further influenced by recurrent state and friction pressure drop. When the formation fluid enters the well bore, flow status inside the well is changed, which influences entrance flow in reverse. Thus, the well bore and the formation are interacted and coupled with each other to form a unified wholeness, and are a large scale system. In order to control the well bore pressure traverse or the well bottom pressure to be at a prospective target value, it is necessary to treat an entire well bore as a system, which is denote as S.

Providing the system with a "trigger", i.e., an input, denoted as I, which can be a controllable parameter such as master factors comprising density, flow rate and rheological parameter of drilling fluid and other parameters of the well bore, or a real-time variable factor comprising casing pressure, the system reacts accordingly, i.e., having an output denoting ad O of well bore pressure traverse or well bottom pressure, which is shown as in FIG. 1 of the drawings.

2. The method for controlling well bore pressure is based on a model of well bore flowing rules, so as to process model-predictive control on the well bore pressure traverse or the well bottom pressure.

Although the well bore system is a fuzzy system influenced by various factors, fluid flow inside the well bore still has hydrodynamic flow characteristics of itself and corresponding theoretical calculation model. However, calculation results of the model are not only affected by inaccuracy of description of objective physical law by the model itself, but also greatly interfered by environmental factors. There may be a difference between a required control result O and an output result. Therefore, the idea of model prediction control (MPC) can be introduced into the system, wherein the well bore pressure is controlled based on prediction of law of the system, in such a manner that based on the law of the system S, the input I outputs a prospective result O, so as to ensure that the well bore pressure controlled thereof maintains in a safety limit at all times.

A detailed technical solution for obtaining an optimal casing pressure to predict and control real-time online pressure of the well bore is as follows.

The well bottom pressure, the stand pipe pressure, the casing pressure, the injection flow rate, the outlet flow rate and the construction technological process are monitored during the whole process, and a basic idea of model prediction control (MPC) is introduced, so as to achieve objects of processing a real-time optimal control of the well bore pressure in a circulation circle during the process of drilling, and processing a foreseeing annular pressure compensation or regulation accordingly, so as to ensure that annulus pressure traverses at each moment in one or more prospective circulation circles are all within a safe range. Basic working principle for controlling the well bottom pressure model prediction is as shown in FIG. 2 and FIG. 3 of the drawings.

Figure 2:
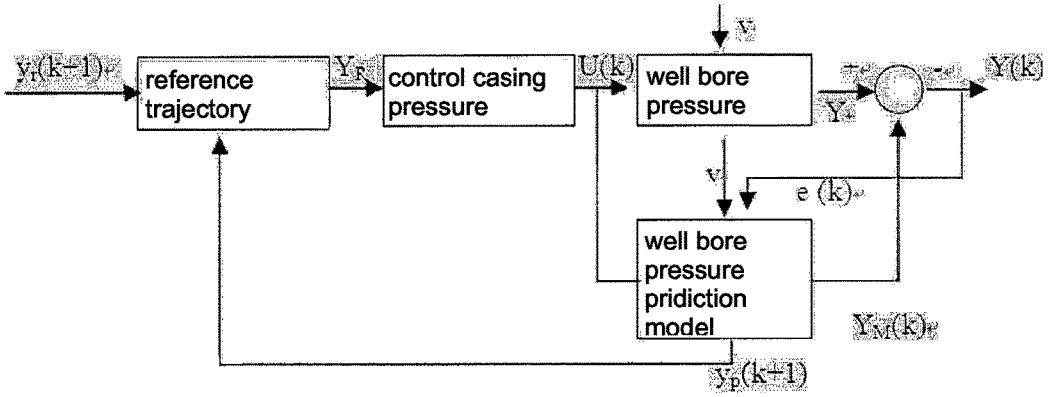
FIG. 2 is a basic principle diagram of a method for controlling well bore pressure based on model prediction control theory and systems theory of the present invention.
Figure 3:
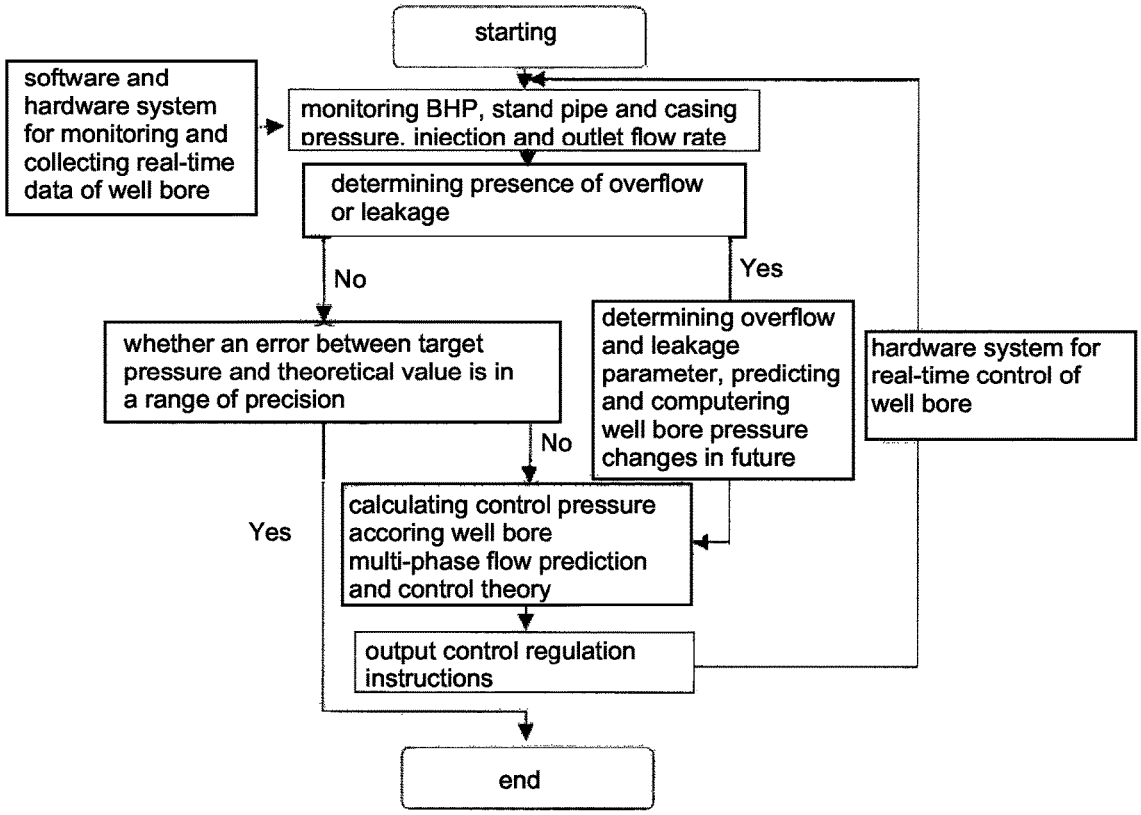
FIG. 3 is a flow chart for optimally controlling the prediction system of the well bore pressure model in real time.

As shown in FIG. 2 and FIG. 3 of the drawings, during the construction process, detecting a well bottom pressure, a stand pipe pressure, a vertical casing pressure, an injection flow rate and an outlet flow rate during construction process;

determining presence of overflow or leakage and determining values thereof;

if there is no overflow or leakage, then fine-adjusting the wellhead casing pressure according to the slight fluctuations of the well bottom pressure, the stand pipe pressure or the casing pressure, so as to ensure that the well bottom pressure, the stand pipe pressure or the casing pressure are at a set value; and if there is overflow or leakage, then using a well bore single-phase or multi-phase flow dynamic model to simulate and calculate the overflow or leakage position and starting time of the overflow or leakage, predicting the variation over a future time period of the well bore pressure in the well drilling process, a circulation circle for example, and promptly utilizing an optimization algorithm to calculate the control parameter under a minimum of an actual well bottom pressure difference (a minimum amount of overflow and leakage) in the security condition mentioned above during a future period, such as casing pressure, displacement, and density and viscosity of the drilling fluid.

Within a certain range of time, the object mentioned above is achieved by adopting different time intervals and under different control settings. After a first control parameter is selected and set, an optimization process for the next time period is repeated.

Figure 4:
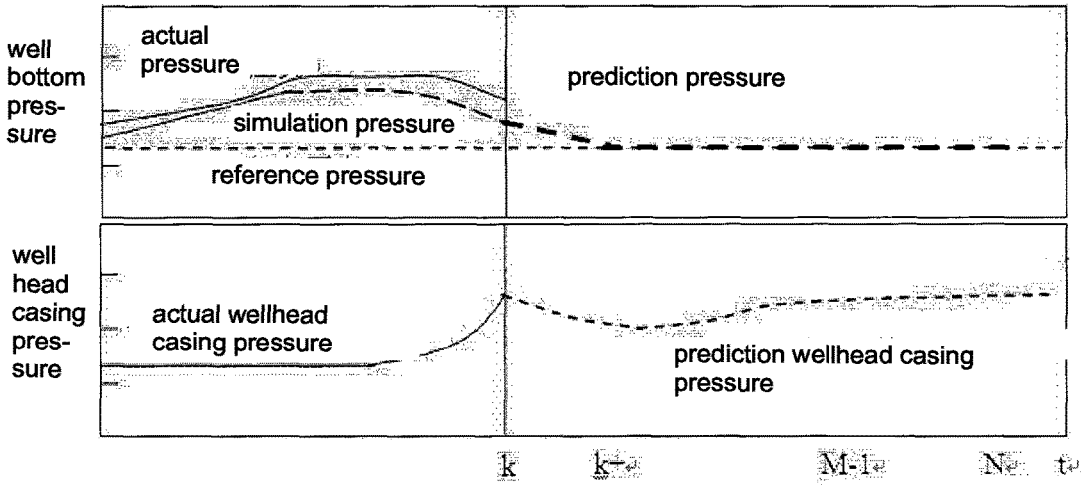
FIG. 4 is a schematic view of the method for controlling the prediction system of the pressure model.

As shown in FIG. 4 of the drawings, discretization time settings are adopted, and time series at a time t is shown, wherein a vertical line in the FIG. 4 shows a current time. In FIG. 4 of the drawings, an actual well bottom pressure curve before the current time and a simulation calculation curve are shown, and simulated parameters are processed with feedback compensation according to actual data. As shown in FIG. 4 of the drawings, the simulation calculation curve at the current moment does not coincide with control points. According to a difference value thereof, a reference curve is set. Calculate curves thereof so as to ensure that differences between a prediction curve and the reference curve are at a minimum value.

Embodiment 3

Referring to accompanying drawings of the specification, a best mode of the present invention is as follows.

A basic algorithm for the controlling method of the prediction system of the well bore pressure model is as follows.

In the well bore system BHP=f($Q_L$,$Q_G$,$\rho_L$,$\mu_L$,$P_c$,$\Delta Q_{KL}$, $H_{KL}$,$T_{KL}$,OD,ID,L,α . . . ), if variable parameters are not determined to be leakage and overflow amount of the drilling fluid, distribution of the well bore pressure changes accordingly, wherein control object is set to be achieved by adjusting the casing pressure.

As shown in FIG. 3 of the drawings, according to control principle of the well bore pressure model prediction, parameter relationship of the well bore pressure can be described as a form of model prediction control equation, which is expressed as follows:

$$\begin{cases} \vec{x} = f_R[\vec{x}(t), u(t), \Delta Q_{KL}] \\ y(t) = g_R[\vec{x}(t)] + e_y \end{cases}, \tag{1}$$

wherein $f_R[\bullet]$, $g_R[\bullet]$ respectively represent well bore pressure system, a computing model thereof is calculated by theoretical formula of hydraulic single-phase flow and multi-phase flow;

$\vec{x}(t)$ represents a state vector at a moment of t, including the casing pressure;

u(t) represents the casing pressure at the moment of t;

y(t) represents the well bottom pressure at the moment of t; and $e_y$ represents an error of the well bottom pressure;

converting the well bore continuous model established into the following discrete model:

$$\begin{cases} \tilde{\vec{x}} = f_M\left[\tilde{\vec{x}}(k-1), \tilde{u}(k), \tilde{u}(k-1), \Delta\tilde{\vec{Q}}_{KL}\right] \\ \tilde{y}(k) = g_M\left[\tilde{\vec{x}}(k)\right] \end{cases}, \tag{2}$$

wherein $\tilde{\vec{x}}$ represents a state vector at a moment of k;

$\tilde{u}(k)$ represents the casing pressure at the moment of k;

$\Delta\vec{Q}_{KL}$ represents ground leakage or overflow vector; and $\tilde{y}(k)$ represents a calculated value of the well bottom pressure at the moment of k;

Time intervals of the discrete nonlinear oil-gas well reservoir model are short than controlled time intervals, so casing pressures within time intervals of two moments are capable of being obtained by processing linear interpolation on two casing pressures u(k−1) and u(k) which are respectively at two adjacent time intervals of k−1 moment and k moment.

An object of the control algorithm is to control the well bottom pressure in accord with a reference pressure $y_{ref}$. Because the actual measurement stand pipe pressure and casing pressure are influenced by noises and model dismatch, there is an error between an actual measurement stand pipe pressure and casing pressure and a prediction calculation stand pipe pressure and casing pressure, which is called a prediction error. During controlling process of the model prediction, the prediction error passes through a predictor, so as to predict error in area of future prediction and are introduced to a reference predict reference trajectory for compensating. There are various methods for predicting errors, e.g., the e(k+i) prediction error is valued as follows, $$e(k+i)=y_p(k)-y_M(k) \tag{3}$$

wherein $y_M(k)$ is an output value of a moment k (the stand pipe pressure, the casing pressure or the well bottom pressure); $y_p(k)$ is an actual measurement value of the moment k (the stand pipe pressure, the casing pressure or the well bottom pressure).

In order to improve precision, predicted value e(k+i) at a moment n+i in the future is usually estimated by a polynomial error fitting method based on values at a given moment, wherein the predicted value e(k+i) comprises an error at a moment k and a revised error, wherein during this process (L>l2>1), and when L=l2

$$\begin{aligned} e(k+i) &= e(k) + \sum_{i=1}^{l_2} e_l(n) i^l \\ &= y_p(k) - y_M(k) + \sum_{i=1}^{l_2} \beta_l(n) i^l \\ (i &= 1, 2, 3, \ldots, L) \end{aligned} \tag{4}$$

wherein e(k) is an error at the moment k;

$\beta_1(k)$ is a coefficient of a fitting polynomial;

$l_2$ is expanded orders of the fitting polynomial.

In order to avoid fluctuations, the well bottom pressure is obtained according to exponential curve close to a reference pressure $y_{ref}$, at the moment, a reference curve of the well bottom pressure is expressed as the following formula:

$$r(k+i|k) = y_{ref} - e^{-\frac{iT_s}{T_{ref}}} \varepsilon(k) \tag{5}$$

wherein i=(1, 2, . . . $H_P$);

wherein $T_s$ represent a sampling time;

$T_{ref}$ represents an exponential time of the reference curve;

wherein symbol r(k+i|k) means evaluating reference curve at a moment (k+i) according to the moment of k and the well bottom pressure is usually predicted according to a nonlinear model, wherein when the well bottom pressure exceeds prediction range of the model, a previous input curve $\hat{u}(k+i|k)$ is utilized to predict the well bottom pressure, wherein:

$$\hat{\vec{x}}(k+i|k)=f_P[\hat{\vec{x}}(k+i-1),\hat{u}(k+i|k),\hat{u}(k+i-1|k),\hat{u}(k+i-2),\ldots,\hat{u}(k|k)] \quad (6)$$

$$\hat{y}(k+i|k)=g_P[\hat{\vec{x}}(k+i|k)] \quad (7)$$

wherein $f_P$ is calculated according to theoretical formula of well bore hydraulic single-phase flow and multi-phase flow.

In the rolling optimization algorithm for controlling the prediction model, an optimal input curve for future control $\hat{u}(k+i|k)$ is obtained by a series of steps comprising iterating, optimizing and constraining, wherein a most commonly utilized method thereof comprises step of:

optimizing prediction output values of the process in a plurality of fitting points to be closest to a reference trajectory, wherein optimization performance indexes thereof are quadratic performance indexes and are solved by optimization method, wherein:

$$\min J_p = \sum_{i=1}^{m} (y_r(k+i) - \tilde{y}_M(k+i))^2 \quad (8)$$

$$\tilde{y}_M(k+i) = y_M(k+i) + e(k+i) \quad (9)$$

wherein (k+i) is a (k+i)th fitting time, m is a number of the fitting points, $\tilde{y}_M(k+i)$ is a prediction value of the process, $y_M(k+i)$ is a model prediction output at a moment of (k+i), e(k+i) is a prediction error, $y_r(k+i)$ is a reference trajectory at the moment of (k+i), wherein an optimal parameter of real-time control is obtained by calculating a minimum value of the formulas mentioned above, an optimal opening of the throttle valve, wherein an optimal opening of the throttle valve means that the well bottom pressure maintains at a reference pressure, $y_{ref}$ is obtained by minimization of a formula via the optimal algorithm.

Since initial casing pressure is known, a first new group of casing pressure curve is explicitly provided by algorithm, i.e., calculating according to the formula (8). Measurement results are analyzed to select a second new group of casing pressure. Then the process is repeated until an optimal control casing pressure which is in accordance with the reference well bottom pressure.

Embodiment 4

On the basis of the example 3, the present invention provides another method for controlling well bore pressure based on model prediction control theory and systems theory: a method for controlling model prediction system based on PWD measured data.

In order to accurately predict pressure variation in a next moment for taking precautions of precise pressure control, so as to ensure that the well bottom pressure maintains at a given range both at the current moment and in the future. The control method of the present invention introduces a basic idea for controlling model prediction in modern control theory to the well bore pressure control. The method of the present invention can be utilized for calculating well bore pressure traverse based on hydraulic theory of well bore, monitoring pressure of the well bottom in real time via a well bottom monitoring method, checking the hydraulic model in real time, predicting and calculating pressure variation of well bore annulus dynamic pressure on the basis of historical information, and determining pressure control measures to be taken. A basic idea of simple algorithm of the method is as follows.

The hydraulic model calculates and analyzes the well bore pressure in real time, so as to provide a control casing pressure $P_C(i)$ at a moment i, $$P_C(i)=BHP_{Target}(i)-P_H(i)-P_F(i) \quad (10)$$

wherein i represents to an ith moment, $BHP_{Target}(i)$ represents a target control value of the well bottom pressure, $P_H(i)$ is a hydrostatic fluid column pressure of the drilling fluid, and $P_F(i)$ represents an annulus friction pressure.

There is an error $\epsilon(i)$ between the well bottom pressure $BHP_M(i)$ by real-time calculation and the actually measured well bottom pressure, $BHP_C(i)$ $$\epsilon(i)=BHP_M(i)-BHP_C(i) \quad (11).$$

Since the actually measured well bottom pressure is known, calculation of the well bottom pressure of a next moment is capable of being amended and checked, in such a manner that the well bottom pressure calculated is more precise, and that both calculated and actually measured well bottom pressures at a next moment are closer to control target of well bottom pressure $BHP_{Target}$:

$$BHP_{Target}\approx BHP_{Predected\ Control}(i+1)=BHP_{Calculated}(i+1)+y(i) \quad (12),$$

wherein $y(i)=\epsilon(i)+f(\epsilon(i))$, $f(\epsilon(i))$ is an error tendency modified function of a first i moments, and a calculation thereof can be processed utilizing model prediction control algorithm in modern control theory.

Thus, well bottom pressure of a next moment can be calculated and predicted thereby, and a control equation of the control casing pressure is provided:

$$P_C(i+1)=BHP_{Target}-P_H(i)-P_F(i)-y(i) \quad (13).$$

During normal drilling process, under conditions with no variation of other duty parameters and leaving out effects of temperature of pressure on pressure of drilling fluid column and on friction, a casing pressure regulating control equation at a next moment is obtained:

$$P_C(i+1)=P_C(i)-f(\epsilon(i)) \quad (14).$$

Embodiment 5

On the basis of example 3 and example 4, the present invention provides another controlling the prediction system of the well bore pressure model: a hydraulic model checking method based on measured data.

When there is no PWD measured data, data of a memory pressure gauge is utilized for checking the hydraulic model for drilling of a next time or checking a hydraulic model of adjoining well with basically same parameters.

A main checking parameter for checking is frictional pressure loss. In general, gravity pressure drop is slightly affected by external factors, so a main factor that determines variations of the well bottom pressure is circulatory frictional pressure loss. Therefore, if well bottom pressure data corresponding to well depth (true vertical depth), actual frictional pressure loss is capable of being calculated. Correlation of the frictional pressure loss calculated by hydraulic model and the actual frictional pressure loss is fitted with changes of the well depth: $f(x)=a+bx+cx^2 \ldots$. Thus, during drilling of a next time, formula of the correlation is utilized for checking circulatory pressure loss of the hydraulic calculation with considering checking coefficients of changes of density, displacement and well depth, which is capable of basically meeting requirements for controlling the well bottom pressure.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method implemented with a controller coupled with memory devices having instructions code stored thereon for controlling well bore pressure, the controller including a computer equipped with capability for processing algorithms, evaluating polynomials and computing mathematical equations included with the stored instructions, wherein the instructions when executed by the computer, implement the method steps, comprising:

detecting a well bottom pressure, a stand pipe pressure, a vertical casing pressure, an injection flow rate and an outlet flow rate during construction process;

determining presence of overflow or leakage;

if there is no overflow or leakage, then fine-adjusting the wellhead casing pressure according to a difference values between the well bottom pressure, the stand pipe pressure, the casing pressure and target pressures thereof, or the slight fluctuations of the well bottom pressure, the stand pipe pressure, or the casing pressure, so as to ensure that the well bottom pressure, the stand pipe pressure, or the casing pressure are at set values, wherein adjusting amount is optimized according to a conventional model prediction control algorithm, so as to calculate a control objective parameter of a next moment;

if there is overflow or leakage, then using a well bore single-phase or multi-phase flow dynamic model to simulate and calculate the overflow or leakage position and starting time of the overflow or leakage, predicting the variation over a future time period of the well bore pressure in the well drilling process, and utilizing an optimization algorithm to calculate the control parameter under a minimum of an actual well bottom pressure difference during a future period; and repeating the optimization process for the next time period after a first control parameter is selected and set;

(1) wherein a prediction control equation of the single-phase or multi-phase flow dynamic model is expressed by the following formula:

$$\begin{cases} \vec{x} = f_R[\vec{x}(t), u(t), \Delta Q_{KL}] \\ y(t) = g_R[\vec{x}(t)] + e_y \end{cases}, \quad (1)$$

wherein $f_R[\bullet]$, $g_R[\bullet]$ respectively represent well bore pressure system, a computing model thereof is calculated by theoretical formula of hydraulic single-phase flow and multi-phase flow;

$\vec{x}(t)$ represents a state vector at a moment of t, including the casing pressure;

u(t) represents the casing pressure at the moment of t;

y(t) represents the well bottom pressure at the moment of t; and $e_y$ represents an error of the well bottom pressure;

(2) wherein an error between an actual measurement casing pressure and a prediction calculation casing pressure is a prediction error e(k+i), $$\text{wherein } e(k+i)=y_p(k)-y_M(k) \quad (3)$$

wherein $y_M(k)$ is an output value of a moment k; $y_p(k)$ is an actual measurement value of the moment k;

(3) wherein a predicted value e(k+i) at a moment n+i in the future is estimated by a polynomial error fitting method based on values at a given moment, wherein the predicted value e(k+i) comprises an error at a moment k and a revised error, wherein during this process (L>l2>1), and when L=l2

$$\begin{aligned} e(k+i) &= e(k) + \sum_{i=1}^{l_2} e_l(n)i^l \\ &= y_p(k) - y_M(k) + \sum_{i=1}^{l_2} \beta_l(n)i^l \\ (i &= 1, 2, 3, \ldots, L) \end{aligned} \quad (4)$$

wherein e(k) is an error at the moment k;

$\beta_1(k)$ is a coefficient of a fitting polynomial;

$l_2$ is expanded orders of the fitting polynomial.

2. The method for controlling well bore pressure, as recited in claim 1, wherein a predicted value e(k+i) at a moment n+i in the future is estimated by a polynomial error fitting method based on values at a given moment, wherein the predicted value e(k+i) comprises an error at a moment k and a revised error, wherein during this process (L>l2>1), and when L=l2

$$\begin{aligned} e(k+i) &= e(k) + \sum_{i=1}^{l_2} e_l(n)i^l \\ &= y_p(k) - y_M(k) + \sum_{i=1}^{l_2} \beta_l(n)i^l \\ (i &= 1, 2, 3, \ldots, L) \end{aligned} \quad (4)$$

wherein e(k) is an error at the moment k;

$\beta_1(k)$ is a coefficient of a fitting polynomial;

$l_2$ is expanded orders of the fitting polynomial.

3. The method for controlling well bore pressure, as recited in claim 2, wherein the well bottom pressure is obtained according to exponential curve close to a reference pressure $y_{ref}$, at the moment, a reference curve of the well bottom pressure is expressed as the following formula:

$$r(k+i|k) = y_{ref} - e^{-\frac{iT_s}{T_{ref}}}\varepsilon(k) \quad (5)$$

wherein i=(1, 2, . . . $H_P$);

wherein $T_s$ represent a sampling time;

$T_{ref}$ represents an exponential time of the reference curve;

wherein symbol r(k+i|k) means evaluating reference curve at a moment (k+i) according to thereof the moment of k and predicting the well bottom pressure according to a nonlinear model, wherein when the well bottom pressure exceeds prediction range of the model, a previous input curve $\hat{u}(k+i|k)$ is utilized to predict the well bottom pressure, wherein:

$$\hat{\vec{x}}(k+i|k)=f_P[\hat{\vec{x}}(k+i-1),\hat{u}(k+i|k),\hat{u}(k+i-1|k),\hat{u}(k+i-2),\ldots,\hat{u}(k|k)] \quad (6)$$

$$\hat{y}(k+i|k)=g_P[\hat{\vec{x}}(k+i|k)] \quad (7)$$

wherein $f_P$ is calculated according to theoretical formula of well bore hydraulic single-phase flow and multi-phase flow.

4. The method for controlling well bore pressure, as recited in claim 1, wherein the well bottom pressure is obtained according to exponential curve close to a reference pressure $y_{ref}$, at the moment, a reference curve of the well bottom pressure is expressed as the following formula:

$$r(k+i|k) = y_{ref} - e^{-\frac{iTs}{T_{ref}}}\varepsilon(k) \quad (5)$$

wherein i=(1, 2, . . . $H_P$);

wherein $T_s$ represent a sampling time;

$T_{ref}$ represents an exponential time of the reference curve;

wherein symbol r(k+i|k) means evaluating reference curve at a moment (k+i) according to thereof the moment of k and predicting the well bottom pressure according to a nonlinear model, wherein when the well bottom pressure exceeds prediction range of the model, a previous input curve $\hat{u}(k+i|k)$ is utilized to predict the well bottom pressure, wherein:

$$\hat{\vec{x}}(k+i|k)=f_P[\hat{\vec{x}}(k+i-1),\hat{u}(k+i|k),\hat{u}(k+i-1|k),\hat{u}(k+i-2),\ldots,\hat{u}(k|k)] \quad (6)$$

$$\hat{y}(k+i|k)=g_P[\hat{\vec{x}}(k+i|k)] \quad (7)$$

wherein $f_P$ is calculated according to theoretical formula of well bore hydraulic single-phase flow and multi-phase flow.

5. The method for controlling well bore pressure, as recited in claim 1, wherein utilizing an optimization algorithm to calculate the control parameter under the minimum actual well bottom pressure difference over the future period specifically comprises:

optimizing prediction output values of the process in a plurality of fitting points to be closest to a reference trajectory, wherein optimization performance indexes thereof are quadratic performance indexes and are obtained by optimization method, wherein:

$$\min J_p = \sum_{i=1}^{m}(y_r(k+i) - \tilde{y}_M(k+i))^2 \quad (8)$$

$$\tilde{y}_M(k+i) = y_M(k+i) + e(k+i) \quad (9)$$

wherein (k+i) is a (k+i)th fitting time, m is a number of the fitting points, $\tilde{y}_M(k+i)$ is a prediction value of the process, $y_M(k+i)$ is a model prediction output at a moment of (k+i), e(k+i) is a prediction error, $y_r(k+i)$ is a reference trajectory at the moment of (k+i), wherein an optimal parameter of real-time control is obtained by calculating a minimum value of the formulas mentioned above.

6. A method implemented with a controller coupled with memory devices having instructions code stored thereon for controlling well bore pressure, the controller including a computer equipped with capability for processing algorithms, evaluating polynomials and computing mathematical equations included with the stored instructions, wherein the instructions when executed by the computer, implement the method steps comprising:

detecting a well bottom pressure, a stand pipe pressure, a vertical casing pressure, an injection flow rate and an outlet flow rate during construction process;

determining presence of overflow or leakage;

if there is no overflow or leakage, then fine-adjusting the wellhead casing pressure according to a difference values between the well bottom pressure, the stand pipe pressure, the casing pressure and target pressures thereof, or the slight fluctuations of the well bottom pressure, the stand pipe pressure, or the casing pressure, so as to ensure that the well bottom pressure, the stand pipe pressure, or the casing pressure are at set values, wherein adjusting amount is optimized according to a conventional model prediction control algorithm, so as to calculate a control objective parameter of a next moment;

if there is overflow or leakage, then using a well bore single-phase or multi-phase flow dynamic model to simulate and calculate the overflow or leakage position and starting time of the overflow or leakage, predicting the variation over a future time period of the well bore pressure in the well drilling process, and utilizing an optimization algorithm to calculate the control parameter under a minimum of an actual well bottom pressure difference during a future period; and repeating the optimization process for the next time period after a first control parameter is selected and set;

wherein an error between an actual measurement casing pressure and a prediction calculation casing pressure is a prediction error e(k+i), $$\text{wherein } e(k+i)=y_p(k)-y_M(k) \quad (3)$$

wherein $y_M$ (k) is an output value of a moment k; $y_p$(k) is an actual measurement value of the moment k;

(1) wherein a predicted value e(k+i) at a moment n+i in the future is estimated by a polynomial error fitting method based on values at a given moment, wherein the predicted value e(k+i) comprises an error at a moment k and a revised error, wherein during this process (L>l2>1), and when L=l2

$$\begin{aligned} e(k+i) &= e(k) + \sum_{i=1}^{l_2} e_l(n)i^l \\ &= y_p(k) - y_M(k) + \sum_{i=1}^{l_2} \beta_l(n)i^l \\ (i &= 1, 2, 3, \ldots, L) \end{aligned} \quad (4)$$

wherein e(k) is an error at the moment k;

$\beta_1$(k) is a coefficient of a fitting polynomial;

$l_2$ is expanded orders of the fitting polynomial;

(2) wherein the well bottom pressure is obtained according to exponential curve close to a reference pressure $y_{ref}$, at the moment, a reference curve of the well bottom pressure is expressed as the following formula:

$$r(k+i|k)=y_{ref}-e^{-(iTs/Tref)}\epsilon(k) \quad (5)$$

wherein i=(1, 2, . . . $H_P$);

wherein $T_s$ represents a sampling time;

$T_{ref}$ represents an exponential time of the reference curve;

wherein symbol r(k+i|k) means evaluating reference curve at a moment (k+i) according to thereof the moment of k and predicting the well bottom pressure according to a nonlinear model, wherein when the well bottom pressure exceeds prediction range of the model, a previous input curve û(k+i|k) is utilized to predict the well bottom pressure, wherein:

$$\hat{\vec{x}}(k+i|k)=f_P[\hat{\vec{x}}(k+i-1),\hat{u}(k+i|k),\hat{u}(k+i-1|k),\hat{u}(k+i-2),\ldots,\hat{u}(k|k)] \quad (6)$$

$$\hat{y}(k+i|k)=g_P[\hat{\vec{x}}(k+i|k)] \quad (7)$$

wherein $f_P$ is calculated according to theoretical formula of well bore hydraulic single-phase flow and multi-phase flow;

(3) wherein utilizing an optimization algorithm to calculate the control parameter under the minimum actual well bottom pressure difference over the future period specifically comprises:

optimizing prediction output values of the process in a plurality of fitting points to be closest to a reference trajectory, wherein optimization performance indexes thereof are quadratic performance indexes and are obtained by optimization method, wherein:

$$\min J_P = \sum_{i=1}^{m} (y_r(k+1) - \tilde{y}_M(k+i))^2 \quad (8)$$

$$\tilde{y}_M(k+i) = y_M(k+i) + e(k+i) \quad (9)$$

wherein (k+i) is a (k+i)th fitting time, m is a number of the fitting points, $\tilde{y}_M$(k+i) is a prediction value of the process, $y_M$(k+i) is a model prediction output at a moment of (k+i), e(k+i) is a prediction error, $y_r$(k+i) is a reference trajectory at the moment of (k+i), wherein an optimal parameter of real-time control is obtained by calculating a minimum value of the formulas mentioned above.

* * * * *